US005810490A

United States Patent [19]

Kondo

[11] Patent Number: 5,810,490

[45] Date of Patent: Sep. 22, 1998

[54] INK RIBBON CASSETTE HOUSING FOR A PRINTER

[75] Inventor: Shinichi Kondo, Miyagi, Japan

[73] Assignee: Sony Corporation, Japan

[21] Appl. No.: 820,656

[22] Filed: Mar. 18, 1997

[30] Foreign Application Priority Data

Mar. 22, 1996 [JP] Japan ..... 8-066507

[51] Int. Cl.[6] ..... B41J 35/28

[52] U.S. Cl. ..... 400/207; 400/208

[58] Field of Search ..... 400/207, 208; 242/598.3, 598.4, 599.3, 129.6

[56] References Cited

U.S. PATENT DOCUMENTS

| | | | |
|---|---|---|---|
| 532,049 | 10/1895 | Shiraishi et al. | 400/208 |
| 4,946,113 | 8/1990 | Riffle et al. | 242/598.3 |
| 5,248,108 | 9/1993 | Zander | 242/598.3 |

FOREIGN PATENT DOCUMENTS

| | | | |
|---|---|---|---|
| 405201087 | 8/1993 | Japan | 400/208 |
| 406055793 | 3/1994 | Japan | 400/208 |
| 406183087 | 7/1994 | Japan | 400/207 |

*Primary Examiner*—Edgar S. Burr
*Assistant Examiner*—Anthony H. Nguyen
*Attorney, Agent, or Firm*—Ronald P. Kanenen

[57] ABSTRACT

An ink ribbon cassette housing for a printer according to the present invention is one having a bearing means which houses a ribbon supply spool shaft wound with an ink ribbon unused and a ribbon takeup spool shaft for taking up a used ink ribbon in a state that both of the spool shafts are separated from each other and which rotatably supports drive-side shaft portions provided on one ends of the respective spool shafts and driven-side shaft portions on the other ends thereof. The ink ribbon cassette housing for a printer includes a bearing means for said drive-side shaft portions being formed of a bearing portion which has a bearing aperture formed through a side wall of the cassette housing, and a bearing means for the driven-side shaft portions has a bearing portion divided into a lower bearing plate having a semicircular lower bearing aperture and an upper bearing plate which has a semicircular upper bearing aperture and which is shifted positionally forward or backward from the lower bearing plate.

3 Claims, 5 Drawing Sheets

INK RIBBON CASSETTE HOUSING FOR A PRINTER

BACKGROUND OF THE INVENTION

1. Field of the Invention

The present invention relates to a cassette housing of an ink ribbon cassette used in a printing apparatus for printing a recorded picture information recorded in the form of an image such as a picture or the like, as a hard copy, i.e., a color photograph.

2. Description of the Related Art

An ink ribbon cassette will be described below with reference to FIG. 1.

The ink ribbon cassette has an ink ribbon unit 1, and a cassette housing 4 which houses the ink ribbon unit 1 is received therein and is formed of a lower half body 2 and an upper half body 3.

The ink ribbon unit 1 has a ribbon supply spool shaft 6 wound with an ink ribbon 5 unused or to be used, and a ribbon takeup spool shaft 7 for taking up a used ink ribbon. The respective spool shafts 6 and 7 have at their one ends drive-side shaft portions 8, 9 rotated by drive shafts of a printing apparatus (not shown). The respective spool shafts 6 and 7 have driven-side shaft portions 10, 11 at their other ends. Though not shown, if the ink ribbon 5 is formed for a color printing, the ink ribbon 5 for color printing has a yellow-color patch Y, a magenta-color patch M and a cyan-color patch M which are repeatedly located therein in that order.

The lower half body 2 of the cassette housing 4 has a substantially boat-like shape. The lower half body 2 has at its one side drive-side bearing portions 12 and 13 respectively having circular bearing apertures 12*a* and 13*a*. The lower half body 2 has at the other side thereof driven-side bearing portions 14 and 15 respectively having U-shaped shaft grooves 14*a* and 15*a* located at positions opposed to the drive-side bearing portions 12 and 13, and the driven-side bearing portions 14, 15 are supported by reinforcing ribs 16, 16. Moreover, the lower half body 2 has a large opening window 17 formed through its bottom wall.

When the ink ribbon unit 1 is attached to the lower half body 2, the drive-side shaft portions 8 and 9 of the spool shafts 6 and 7 are rotatably supported by the bearing apertures 12*a* and 13*a* of the drive-side bearing portions 12 and 13, respectively, and the driven-side shaft portions 10 and 11 of the spool shafts 6 and 7 are rotatably supported by the shaft grooves 14*a* and 15*a* of the driven-side bearing portions 14 and 15, respectively. At this time, these driven-side shaft portions 10 and 11 are pressed at their shaft ends by compression springs 18 and 19 attached to a side wall of the lower half body 2 to thereby be biased toward the drive-side shaft portions 8, 9. When the spool shafts 6 and 7 are rotatably housed in the lower half body 2, the ink ribbon 5 stretched between the spool shafts 6 and 7 is exposed through the opening window 17 formed through the lower half body 2.

The upper half body 3 is integrally attached to the lower half body 2 so as to correspond to the driven-side bearing portions 14 and 15 thereof. The upper half body 3 has plate springs 20 and 21 for respectively pressing down the driven-side shaft portions 10 and 11 of the spool shafts 6 and 7 supported in the driven-side bearing portions 14 and 15. These plate springs 20, 21 serve to prevent the driven-side shaft portions 10 and 11 from coming off from the driven-side bearing portions 14 and 15.

The cassette housing 4 of the ink ribbon cassette case described above is formed of the lower half body 2 and the upper half body 3 which are individually worked by injection molding using a die. The lower half body 2 has the drive-side bearing portions 12 and 13 for respectively housing the drive-side shaft portions 8 and 9 of the spool shafts 6 and 7 and the driven-side bearing portions 14 and 15 for respectively housing the driven-side shaft portions 10 and 11 of the spool shafts 6, 7. If the cassette housing is formed of only the lower half body 2 shown in FIG. 1, then it is easy to mold the above bearing portions 12 to 15.

In consideration of cost reduction of the cassette housing and effective use of materials therefor, it is desirable that these lower and upper half bodies 2 and 3 are integrally formed. If the lower and upper half bodies 2, 3 are integrally formed, the driven-side bearing portions 14 and 15 must be molded so as to have circular bearing apertures 22 and 23 shown in FIG. 2 instead of the U-shaped shaft grooves 14*a* and 15*a*.

However, if the circular bearing apertures 22 and 23 are molded by using an inner slide molding requiring an insert other than a main die, there is then the problem that the entire cost of dies becomes high along with the unit price of the product. Also, if the circular bearing apertures 22 and 23 are molded by using an outer slide molding using one set of a plurality of dies, then a capacity of one set of the plurality of dies is increased and hence a wide space therefor is required, which is not preferable due to the cost of equipment.

SUMMARY OF THE INVENTION

In view of such aspects, it is an object of the present invention to obtain an ink ribbon cassette housing for a printer which can have a bearing structure that does not require an upper half body and can be molded with a die having a simple structure.

According to the present invention, an ink ribbon cassette housing for a printer has a bearing means which houses a ribbon supply spool shaft wound with an unused ink ribbon, and a ribbon takeup spool shaft for taking up a used ink ribbon, with both of the spool shafts separated from each other. The housing rotatably supports drive-side shaft portions provided on one end of the respective spool shafts and driven-side shaft portions on the other end thereof. The ink ribbon cassette housing for a printer includes a bearing means for said drive-side shaft portions being formed of a bearing portion which has a bearing aperture formed through a side wall of the cassette housing, and a bearing means for the driven-side shaft portions having a bearing portion divided into a lower bearing plate having a semicircular lower bearing aperture, and an upper bearing plate which has a semicircular lower bearing aperture and which is shifted positionally forward or backward from the lower bearing plate using a means, mounting the copper plate, for shifting forward and backward relative to the lower bearing plate.

DESCRIPTION OF THE PREFERRED EMBODIMENT

An ink ribbon cassette housing according to an embodiment of the present invention will be described below with reference to the accompanied drawings.

Figure 1:
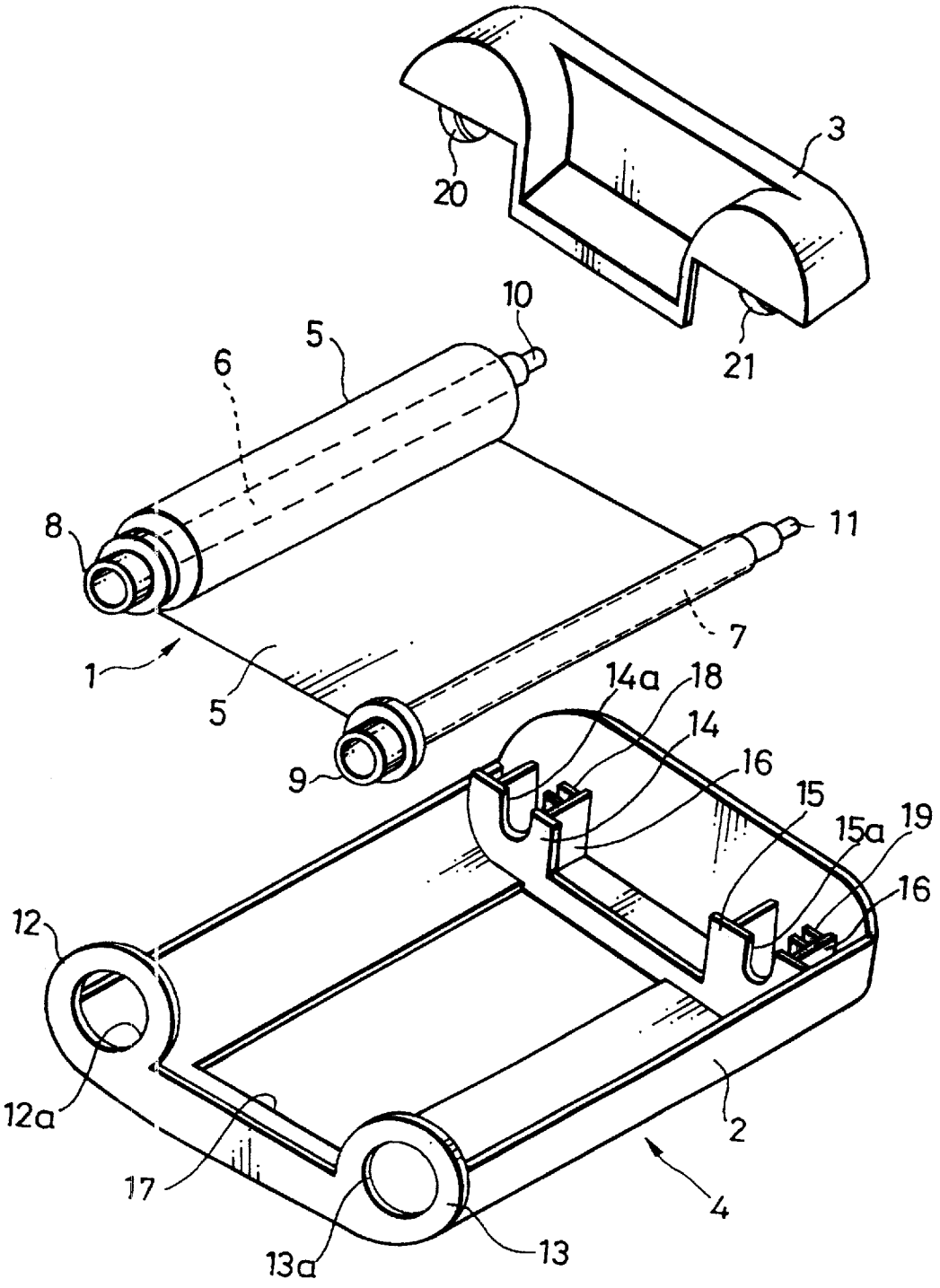
FIG. 1 is an exploded perspective view of an example of an ink ribbon cassette.
Figure 3:
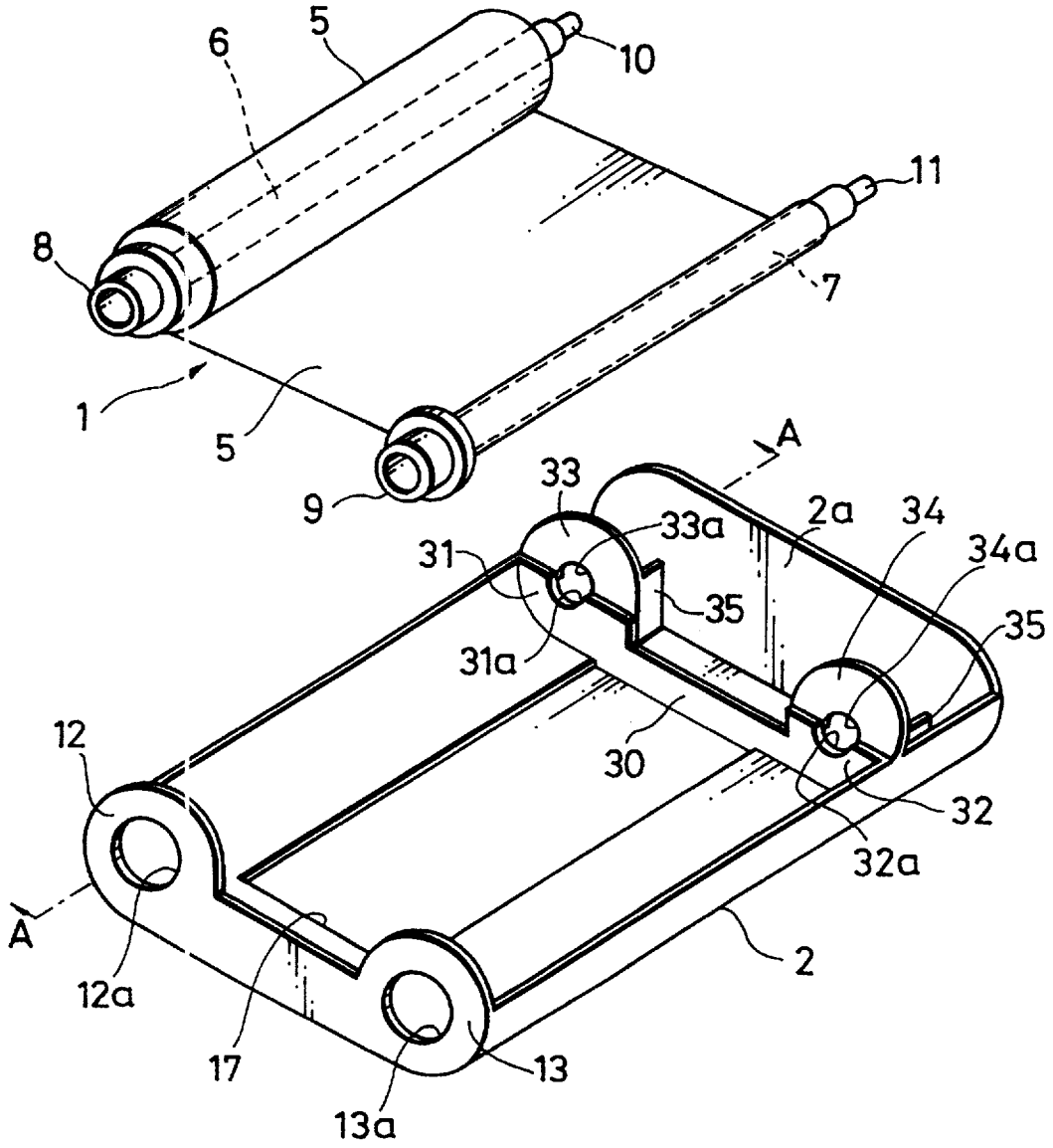
FIG. 3 is a perspective view showing an ink ribbon cassette in a state before an ink ribbon unit is attached to a cassette housing according to the present invention.
Figure 4:
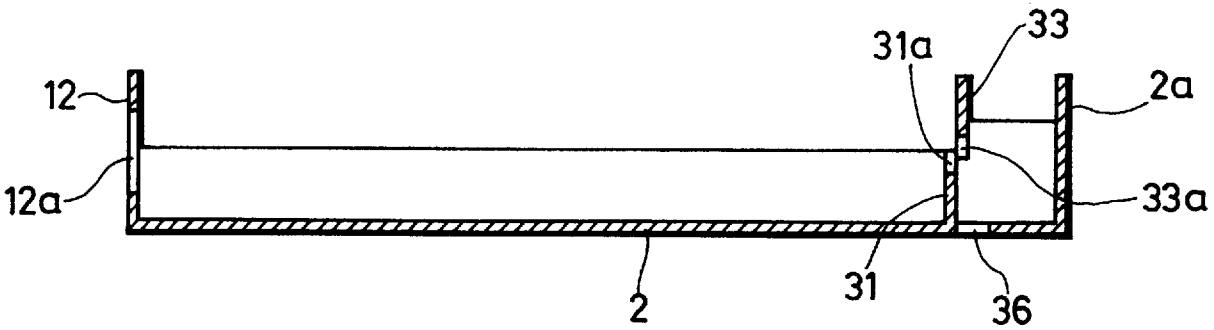
FIG. 4 is a cross sectional view of the housing cut along a line A—A of FIG. 3.

FIG. 3 is a perspective view showing an ink ribbon cassette where a cassette housing including only a lower half body similar to that shown in FIG. 1 and an ink ribbon unit are separated. FIG. 4 is a cross-sectional view of the lower half body cut along a line A—A of FIG. 3. In FIGS. 3 and 4, like parts and portions corresponding to those shown in FIG. 1 are marked with the same reference numerals except that a cassette housing is depicted by reference numeral 2 in FIGS. 3 and 4.

The cassette housing 2 has a substantially boat-like shape. As shown in FIG. 3, the cassette case 2 has drive-side bearing portions 12 and 13 respectively having circular bearing apertures 12*a* and 13*a* into which drive-side shaft portions 8 and 9 of an ink ribbon spool shafts 6 and 7 are inserted. Further, the cassette housing 2 has a large opening window 17 formed therethrough at its bottom wall.

The cassette housing 2 has driven-side bearing portions through which driven-side shaft portions 10 and 11 of the ink ribbon spool shafts 6 and 7 are inserted. The driven-side bearing portions are arranged as follows.

The cassette housing 2 has lower bearing plates 31 and 32 provided so as to stand from the bottom wall thereof together with a connecting plate 30 formed integrally with the lower bearing plates 31 and 32. Both of the lower bearing plates 31 and 32 respectively have semicircular lower bearing apertures 31*a* and 32*a* formed therethrough. The lower bearing plates 31 and 32 are formed integrally with upper bearing plates 33 and 34 which are positionally shifted backward by a plate thickness as shown in FIG. 4 in a divided fashion, respectively. These upper bearing plates 33 and 34 respectively have semicircular upper bearing apertures 33*a* and 34*a*. The semicircular lower and upper bearing apertures 31*a* and 33*a* and the semicircular lower and upper bearing apertures 32*a* and 34*a* respectively form circular bearing apertures.

The upper bearing plates 33 and 34 are respectively reinforced by supporting plates 35 and 35 located between the plates 33 and 34 and a side wall 2*a* of the cassette housing 2 so as to connect them. In FIG. 4, a reference numeral 36 depicts a relief aperture which is an opening formed through the bottom wall of the cassette housing 2 for releasing a die used for molding the upper bearing apertures 33*a* and 34*a*.

Figure 2:
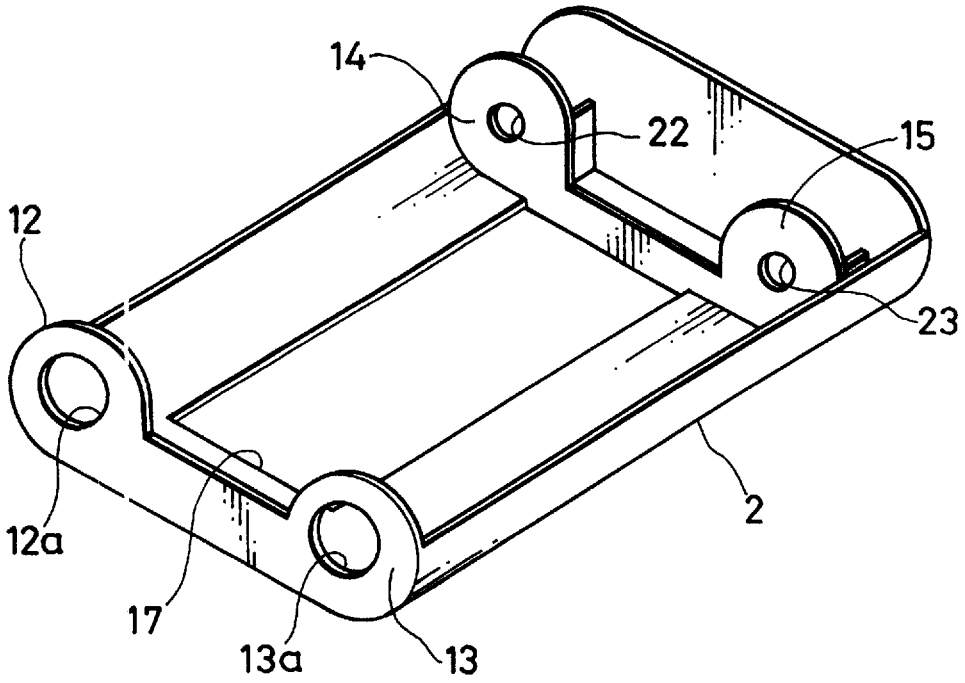
FIG. 2 is a perspective view of another example of a cassette housing.

An ink ribbon unit 1 shown in FIG. 3 has the same construction as that of the ink ribbon unit 1 shown in FIG. 2. Specifically, the ink ribbon unit 1 has a ribbon supply spool shaft 6 wound with an ink ribbon 5 that is either unused or to be used, and a ribbon takeup spool shaft 7 for taking up a used ink ribbon. The respective spool shafts 6 and 7 have at their one ends drive-side shaft portions 8, 9 rotated by drive shafts of a printing apparatus (not shown). The respective spool shafts 6 and 7 have driven-side shaft portions 10, 11 at their other ends.

The ink ribbon unit 1 is pivotally housed in the cassette housing 2 such that the drive-side shaft portions 8 and 9 of the spool shafts 6 and 7 are respectively inserted through the drive-side bearing portions 12 and 13 of the cassette housing 2. Furthermore, the respective driven-side shaft portions 10 and 11 thereof are inserted through the bearing aperture formed by the semicircular bearing apertures 31*a* and 33*a* of the cassette housing 2 and the bearing aperture formed by the semicircular bearing apertures 32*a* and 34*a* thereof. Also, the respective shaft ends of the driven-side shaft portions 10 and 11 are pressed by compression springs (not shown) supported by the side wall 2*a*. Hence the ink ribbon unit 1 pivotally housed in the cassette housing 2 is biased toward the side of the drive-side shaft portions 8 and 9.

As described above, the cassette housing 2 according to the present invention has a bearing structure in which the driven-side shaft portions 10 and 11 of the ink ribbon unit 1 are pivotally supported by the semicircular bearing apertures 31*a* and 33*a* formed by the lower and upper bearing plates 31 and 33 and the semicircular bearing apertures 32*a* and 34*a* formed by the lower and upper bearing plates 32 and 34, respectively. Thus, the driven-side shaft parts 10 and 11 can be prevented from coming off from the bearing portions of the cassette housing 2. This arrangement makes it unnecessary to employ an upper half body shown in FIG. 1, and hence it becomes possible to employ the arrangement employing only the cassette housing 2 shown in FIG. 3.

Although the bearing portions of the cassette housing 2 for the driven-side shaft portions are formed of the lower bearing plates 31 and 32 and the upper bearing plates 33 and 34 in two-divided fashion, the bearing plates 31 to 34 are integrally formed, which increases the strength of bearing portion.

Figure 5:
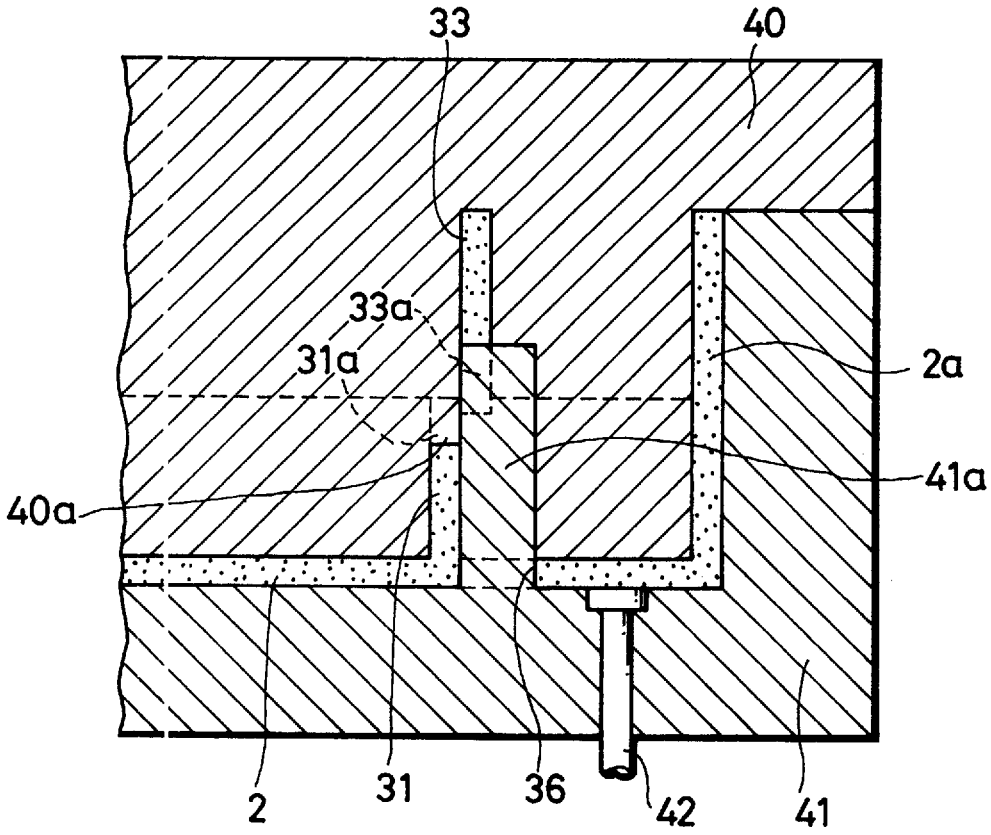
FIG. 5 is a cross sectional view showing a die used for molding the cassette housing according to the present invention.

A method of molding the bearing portions of the above driven-side bearing portions 10, 11 by using an injection molding die will be described with reference to FIG. 5 which is a cross-sectional view of the die used for molding the bearing portions of the one driven-side bearing portion 10.

A molding die is formed of a stationary upper die 40 and a movable lower die 41. A cassette housing 2 is molded in a cavity formed of the upper and lower dies 40 and 41. An outer profile of the cassette housing 2 is molded by means of the lower die 41, while an inner profile thereof is molded by the upper die 40. In FIG. 5, a reference numeral 42 depicts an ejecting pin for releasing a molded product from the lower die 41 after the cassette housing 2 is molded.

The lower bearing plate 31 of the cassette housing 2 is molded by means of the upper die 40, while the lower bearing aperture 31*a* thereof is molded by a lower bearing aperture trimming die 40*a* provided in the upper die 40. The upper bearing plate 33 of the cassette housing 2 is molded by the upper die 40, while the upper bearing aperture 33*a* is molded by an upper bearing aperture trimming die 41*a* provided in the lower die 41. Specifically, the upper bearing aperture trimming die 41*a* is projected from the lower die 41 into the upper die 40 through the cavity. Thus, a relief aperture 36 for releasing the upper bearing aperture trimming die 41*a* from the molded product after the cassette housing 2 is molded is formed in the vicinity of the upper bearing aperture trimming die 41*a*.

As described above, the dies used for molding the cassette housing 2 according to the present invention can simply be formed of only the upper die 40 and the lower die 41 without employing a complicated die including an insert or the like. Therefore, it is possible to reduce the costs of the dies and hence it is possible to reduce a unit price of the molded product. Moreover, since the construction of the molding dies is simple, maintenance and check thereof is facilitated.

While in the above embodiment the respective bearing portions of the cassette housing 2 are divided into two plates, i.e., the lower and upper bearing plates 31, 33 and the lower and upper bearing plates 32, 34 formed integrally, the present invention is not limited thereto and can be applied to a construction in which there are slight gaps between the lower and upper bearing plates 31, 33 and between the lower and upper bearing plates 32, 34. In this case, it is possible to achieve the same bearing effect as described above.

While in the above embodiment the upper bearing plates 33 and 34 are shifted backward from the lower bearing plates 31 and 32, the present invention is not limited thereto and the upper bearing plates 33 and 34 may be shifted forward from the lower bearing plates 31 and 32. In both cases, the relief apertures for the dies are formed through the bottom portions of the cassette housing 2 which are formed immediately below the upper bearing plates 33, 34.

If the drive-side bearing portions 12 and 13 of the cassette housing 2 are respectively divided into two plates, i.e., upper and lower bearing plates as carried out in the driven-side bearing portions, then it is possible to simplify the molding dies.

As described above, according to the ink ribbon cassette housing for a printer of the present invention, each of the bearing means for the driven-side shaft portions of the ink ribbon unit is formed of the bearing portion formed of the lower bearing plate having the semicircular lower bearing aperture and the upper bearing plate shifted forward or backward relative to the lower bearing plate and having the semicircular bearing aperture. Therefore, it is possible to form the cassette housing of only a single-unit body cassette housing without employing the upper half body shown in FIG. 1. As a result, it is possible to achieve the effect in which costs of the cassette housing are reduced and a consumption amount of a source of material is reduced.

Moreover, since, when the cassette housing 2 is molded by using the die, the lower bearing plate is molded together with the lower bearing aperture by the upper die, and the upper bearing plate is molded together with the upper bearing aperture by the lower die, the driven-side bearing portions can be molded with a die having a simple construction. This construction can reduce costs for the die and lower a unit price of the molded product. Further, since the construction of molding dies is simple, maintenance or check thereof can be facilitated.

Also, each of the drive-side bearing portions is formed of the lower and upper bearing plates which are integrally formed, and the strength of the bearing portion can be improved, which can provide the highly reliable bearing portions.

Having described a preferred embodiment of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. An ink ribbon cassette housing for a printer having a bearing means which houses a ribbon supply spool shaft wound with an unused ink ribbon and a ribbon takeup spool shaft for taking up a used ink ribbon in a state wherein both of the spool shafts are separated from each other, and which rotatably supports drive-side shaft portions provided on one end of the respective spool shafts and driven-side shaft portions on the other end thereof, comprising:

a bearing means for said drive-side shaft portions being formed of a bearing portion which has a bearing aperture formed through a side wall of said cassette housing; and a bearing means for said driven-side shaft portions having a bearing portion divided into a lower bearing plate having a semicircular lower bearing aperture, and an upper bearing plate which has a semicircular upper bearing aperture and which is shifted positionally forward or backward from said lower bearing plate using a means, mounting the upper bearing plate, for shifting forward and backward relative to the lower bearing plate.

2. An ink ribbon cassette housing for a printer according to claim 1, further comprising an upper die and a lower die, wherein when said bearing portion of said driven-side shaft portions is molded, said lower bearing plate being molded together with said lower bearing aperture by the upper die, and said upper bearing plate being molded together with said upper bearing aperture by the lower die.

3. An ink ribbon cassette housing for a printer according to claim 1, wherein in said bearing portion for said driven-side shaft portion, said lower and upper bearing plates are integrally formed.

* * * * *